US008844839B1

(12) United States Patent
Touchet

(10) Patent No.: US 8,844,839 B1
(45) Date of Patent: Sep. 30, 2014

(54) SPRINKLER DONUT AND METHOD OF MAKING

(71) Applicant: Chad Touchet, Houston, TX (US)

(72) Inventor: Chad Touchet, Houston, TX (US)

( * ) Notice: Subject to any disclaimer, the term of this patent is extended or adjusted under 35 U.S.C. 154(b) by 247 days.

(21) Appl. No.: 13/626,752

(22) Filed: Sep. 25, 2012

(51) Int. Cl.
*B05B 15/00* (2006.01)

(52) U.S. Cl.
CPC ..... *B05B 15/001* (2013.01)
USPC ..... 239/288.5; 428/66.6; 264/333

(58) Field of Classification Search
CPC ..... B05B 15/001
USPC ..... 428/66.6; 239/288.5; 106/724; 264/333
See application file for complete search history.

(56) References Cited

U.S. PATENT DOCUMENTS

| | | | |
|---|---|---|---|
| 4,146,181 | A | 3/1979 | Soos |
| 4,170,443 | A | 10/1979 | Becker |
| 5,213,262 | A | 5/1993 | Violette |
| 7,717,360 | B1 | 5/2010 | Kander |
| 2005/0279858 | A1 | 12/2005 | Lanni |
| 2009/0026286 | A1 | 1/2009 | Park |
| 2009/0082493 | A1 | 3/2009 | Taylor et al. |

*Primary Examiner* — Alexander Thomas
(74) *Attorney, Agent, or Firm* — Buskop Law Group, PC; Wendy Buskop

(57) ABSTRACT

An accelerated cure method for making a strong, high durometer, reduced brittleness hydrated sprinkler protection device shaped like a donut by mixing water with a dry mixture of sand; Portland cement; pigment; and polypropylene homopolymer fibers.

5 Claims, 2 Drawing Sheets

SPRINKLER DONUT AND METHOD OF MAKING

FIELD

The present embodiments generally relate to a sprinkler donut and method of making.

BACKGROUND

A need exists for a sprinkler donut or sprinkler protection device that is durable and not brittle and can be transported in stacked layers higher than two.

A further need exists for a non-plastic sprinkler protection device without a stem which won't float away in rain storms.

A need exists for a sprinkler protection device that is at least 10 percent in weight lighter than ordinary concrete donuts that are used around sprinkler heads.

Ordinary sprinkler donuts made from concrete are heavy and must be packed carefully using Styrofoam peanuts in large boxes to prevent breakage in transit. The donuts made by the current method are strong, and can be stacked in at least 10 layers deep and shipped without breakage.

The present embodiments meet these needs.

BRIEF DESCRIPTION OF THE DRAWINGS

The detailed description will be better understood in conjunction with the accompanying drawings as follows.

Figure 1:
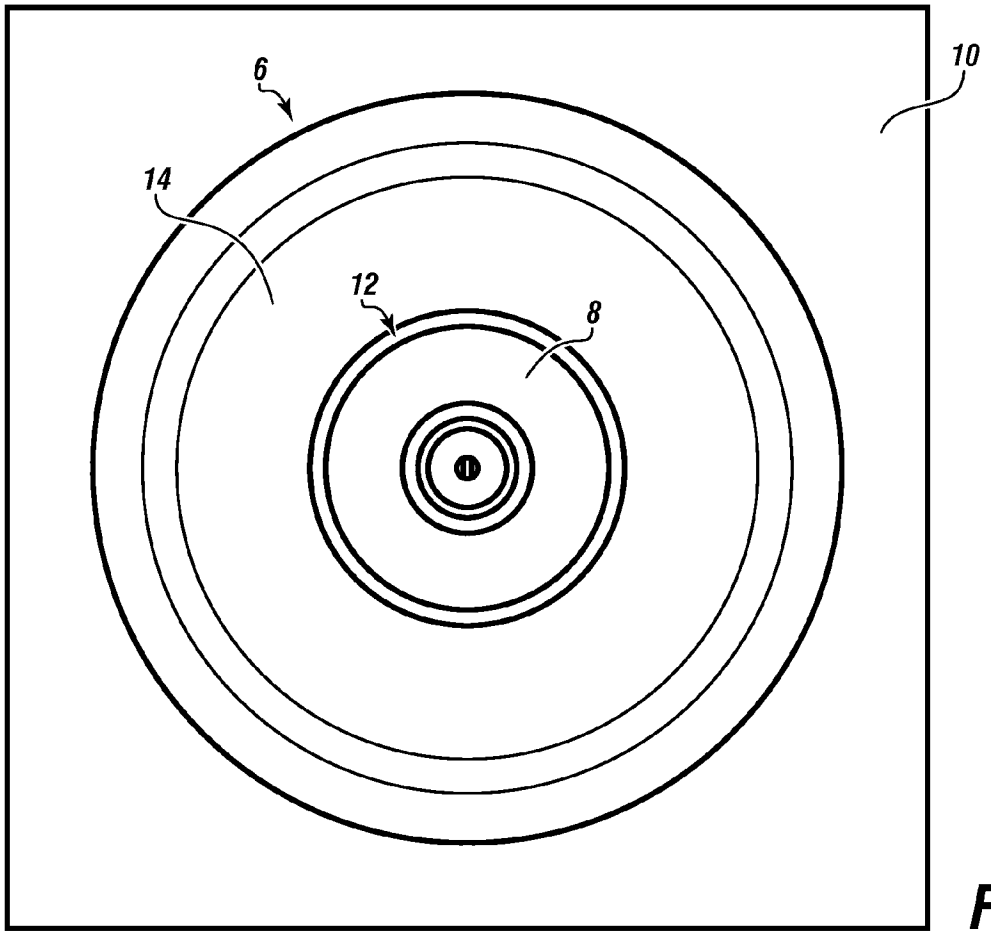
FIG. 1 depicts a sprinkler donut made by the method.

The present embodiments are detailed below with reference to the listed Figures.

DETAILED DESCRIPTION OF THE EMBODIMENTS

Before explaining the present apparatus and method in detail, it is to be understood that the apparatus and method are not limited to the particular embodiments and that they can be practiced or carried out in various ways.

The embodiments relate to an accelerated cure method for making a strong, high, hydrated sprinkler protection device shaped like a donut with reduced brittleness compared to cement donuts used for sprinkler protection.

The method produces a donut device for a sprinkler head that is at least 10 percent lighter than concrete donuts. In an embodiment, the sprinkler donut of a 6 inch diameter can weight only 64 ounces, whereas a concrete donut of the same size would weigh 72 ounces.

The method can involve mixing water with a dry mixture of sand; Portland cement; pigment; and polypropylene homopolymer fibers, then blending this mixture with an accelerating admixture, which can include poly alphamethylstyrene, forming a donut material.

The method involves spraying a donut shaped mold with a urethane release agent then placing the sprayed donut shaped molds in a controlled environment, at a temperature from about 96 degrees Fahrenheit to about 101 degrees Fahrenheit and at a humidity of at least 85 percent.

Next, the donut material can be deposited into the sprayed mold.

An evaporation retardant can then be sprayed on the donut material while the donut material is still in the mold in the controlled environment, prior to curing the donut material in the controlled environment.

The evaporation retardant prevents evaporation of water from the donut material, hydrating the donut material.

The donut is allowed to remain in the mold for 8 to 12 hours in the controlled environment to cure. Once cured, a strong, lightweight donut can be removed from the mold, and stacked for shipping without breakage.

A lightweight donut made by this method, in an example can have a diameter from 6 inches to 8 inches across the bottom, with an inside diameter from 2 inches to 4 inches, and a height from 1 inch to 2 inches, and weighs from 2.5 pounds to 4.5 pounds.

These sprinkler head protection devices are donuts intended for standard lawn pop-up rotor heads and spray heads.

The sprinkler head protection donuts made by this method fit almost all medium-sized pop-up lawn rotor heads such as the Hunter PGP Rotor Series, Hunter SRM Series, Hunter I-20 and I-20 Ultra Series, Irritrol CR-500 Series, Rainbird T-Bird Series, Rainbird 3500 Series, Rainbird 5000 Series, Rainbird 5000 Plus Series and the Toro Super 600 Series, Super 700 Series, Super 800 Series and the Toro V-1550 Series, and will also fit almost all brands of traditional pop-up lawn rotor heads having an outside maximum diameter of 3.2 inches or less.

These composite durable hydrated sprinkler head protection donuts are superior to the plastic variety because sprinkler head protection donuts made by this method do not float away when it rains. These composite hydrated donuts made by the method do not crack or break easily.

The term "evaporation retardant" can refer to a coating that is applied to the donut by spraying, coating, dipping, or a similar method to create a thin film on the donut material prior to curing of the donut material. When sprayed over the wet, fresh mixture, that is not yet "set", the evaporation retardant can form a thin, continuous film which prevents rapid moisture loss from the surface of the donut material. This thin film of evaporation retardant is easy to use requiring only the addition of water before spraying, coating, dipping, or similar method.

In one or more embodiments, the product known as EUCOBAR™ from Euclid Chemical Company of Cleveland, Ohio is especially effective as an evaporation retardant when used in this method, and it can be applied to the donut material easily since it has a low toxicity level, and produces no green house gases. When sprayed over the fresh donut material, EUCOBAR™ forms a thin, continuous film which prevents rapid moisture loss from the donut surface.

Usable evaporation retardants can be water based polymer concentrates. In other embodiments, the evaporation retardant can be a water based polymer.

"Portland cement" as the term is used herein can refer to material that is a two-thirds by mass of calcium silicates (3 $CaO.SiO_2$ and 2 $CaO.SiO_2$), the remainder consisting of aluminum- and iron-containing clinker phases and other compounds. The ratio of CaO to $SiO_2$ is not less than 2.0. If magnesium oxide is present, then the magnesium oxide content (MgO) will typically not exceed 5.0 percent by mass.

The term "accelerating admixture" as used herein can refer to an admixture that causes an increase in the rate of hydration of the Portland cement, and uniquely both (i) shortens the time of setting for the donut material that incorporates the Portland cement and (ii) increases the rate of strength development in the composite, creating a very hard substance. This "accelerating admixture" provides two benefits simultaneously, quickening of the hardening and strength of the final cured product both in increased durometer and reduced brittleness.

An example of a usable "accelerating admixture" can be EUCON Ac™ available form Euclid Chemical Company. The accelerating admixture can increase in velocity or in rate of change, the quickening of the natural progress of the blends curing process such as setting and strength development (hardening) of the donut material composite. In one or more embodiments, the accelerating admixture can include poly alphamethylstyrene.

The term "sand" as the term is used herein can refer to a cleaned, sifted particulate silica, which can also be homogeneous, with particle sizes ranging from 1 mm to 6 mm. In an embodiment, the sand is without aggregate or other material mixed therein.

The sand can have particulate sizes that are defined by classes that are given names in the Wentworth scale (or Udden-Wentworth) used in the United States. The Krumbein phi (ϕ) scale, a modification of the Wentworth scale created by W. C. Krumbein, (Krumbein & Sloss 1963) is a logarithmic scale computed by the equation:

$\phi=-\log_2 D/D_0$, where ϕ is the Krumbein phi scale, D is the diameter of the particle, and $D_0$ is a reference diameter, equal to 1 mm (to make the equation dimensionally consistent). This equation can be rearranged to find diameter using ϕ:

$$D=D_0\times 2^{-\phi}$$

For clarification, the following scale is used to define the sand usable herein:

| ϕ scale | Size range (metric) | Size range (approx. inches) | Aggregate name (Wentworth Class) | Other names |
|---|---|---|---|---|
| −8< | 256 mm< | 10.1 in< | Boulder | |
| −6 to −8 | 64-256 mm | 2.5-10.1 in | Cobble | |
| −5 to −6 | 32-64 mm | 1.26-2.5 in | Very coarse gravel | Pebble |
| −4 to −5 | 16-32 mm | 0.63-1.26 in | Coarse gravel | Pebble |
| −3 to −4 | 8-16 mm | 0.31-0.63 in | Medium gravel | Pebble |
| −2 to −3 | 4-8 mm | 0.157-0.31 in | Fine gravel | Pebble |
| −1 to −2 | 2-4 mm | 0.079-0.157 in | Very fine gravel | Granule |
| 0 to −1 | 1-2 mm | 0.039-0.079 in | Very coarse sand | |
| 1 to 0 | ½-1 mm | 0.020-0.039 in | Coarse sand | |
| 2 to 1 | ¼-½ mm | 0.010-0.020 in | Medium sand | |
| 3 to 2 | 125-250 μm | 0.0049-0.010 in | Fine sand | |
| 4 to 3 | 62.5-125 μm | 0.0025-0.0049 in | Very fine sand | |
| 8 to 4 | 3.90625-62.5 μm | 0.00015-0.0025 in | Silt | Mud |
| >8 | <3.90625 μm | <0.00015 in | Clay | Mud |
| >10 | <1 μm | <0.000039 in | Colloid | Mud |

In some schemes, gravel is anything larger than sand (comprising granule, pebble, cobble, and boulder).

The term "water" as used in this method can refer to clean tap water, or available clean water with up to 5 weight percent mineral content. The term "clean" can refer to potable water.

The term "urethane release agent" can refer to an aliphatic hydrocarbon with a flash point of 17.6 F, a lower flammability limit of 0.9 percent and an upper flammability limit of 6.3 percent and an autoignition temperature of 828 degrees Fahrenheit. For example, a usable urethane release agent can be a product known as M804 available from Stoner Inc. of Quarryville, Pa.

The term "controlled environment" can refer to a vessel or controlled air space maintained at a temperature from 96 degrees and 101 degrees Fahrenheit without deviation to a lower or higher temperature with a humidity from 85 percent to 100 percent that does not drop below 85 percent humidity.

The method can relate to an accelerated cure technique for making a strong, high durometer, reduced brittleness hydrated sprinkler donut, and to the donut made by the method.

The accelerated cure method can have as a step, mixing for 2 minutes to 5 minutes at least 5 weight percent to 8 weight percent water with 92 weight percent to 95 weight percent of a dry mixture. This mixing can occur in a controlled environment, or in a warehouse space that has powder controls in place.

The dry mixture can contain 30 weight percent to 53 weight percent sand based on the total blend of dry ingredients in the dry mixture.

In addition, the dry mixture can contain 20 weight percent to 40 weight percent Portland cement.

The dry mixture can have from 0.001 weight percent to 2 weight percent pigment disposed in it.

The dry mixture can be supplemented with 0.00001 weight percent to 0.0002 weight percent polypropylene homopolymer fibers cut into strands less than 0.5 of an inch in length. In an embodiment a dry mixture might have 0.00093 weight percent polypropylene fiber in it.

The dry ingredients can then be blended, such as in a high shear mixer for about 3 minutes to about 4 minutes forming a first blend.

To the first blend from 0.5 weight percent to 1 weight percent of an accelerating admixture is added and then blended for another 3 to 4 minutes forming an uncured donut material.

The accelerating admixture can be 30 weight percent to 60 weight percent calcium chloride; and 40 weight percent to 60 weight percent water. It should be noted that the weight percent of the water is based on the total weight percent of only the accelerating admixture.

While the uncured donut material is being blended, at least one donut shaped mold can then be thinly coated with a urethane release agent. The release layer can be deposited by spraying but can also be deposited in the mold using a brush for coating, dipping, or other similar methods. The release layer can be deposited on the inside of the mold to a thickness of at least 1 millimeter.

The donut shaped molds are then placed in a controlled environment.

The controlled environment is maintained at a temperature from 96 degrees Fahrenheit to 101 degrees Fahrenheit and at humidity of at least 85 percent.

The uncured donut material can then be deposited into the sprayed donut shaped mold in the controlled environment. While the donut material is still uncured, an evaporation retardant can be sprayed or coated over the uncured donut material as the donut material resides in the mold prior to cure, such as within 5 minutes to 8 minutes of placing the donut material in the donut shaped mold in the controlled environment.

The evaporation retardant can be a blend of 45 weight percent to 60 weight percent water with 1 weight percent to 5 weight percent cetyl alcohol with the balance being a water soluble polymer.

After the evaporation retardant is applied, the donut is allowed to remain in the mold 8 to 12 hours in the controlled environment. After only 8 hours, the donut can be removed from the mold for use around sprinkler heads of irrigation systems.

In one or more embodiments, the donuts made by this process, when dropped from an 18 inch height onto a steel plate did not fracture. Concrete donuts, when dropped from the same sight, fractured at 18 inches but also at only 9 inch heights as well as 6 inch heights. This drop test results suggests the donuts made by the current method are actually at least three times stronger and more durable than comparable concrete donuts.

In an embodiment, urethane can be sprayed onto the mold.

In an embodiment, the pigment used in the formulation can be green, red, yellow, purple or blue.

Figure 2:
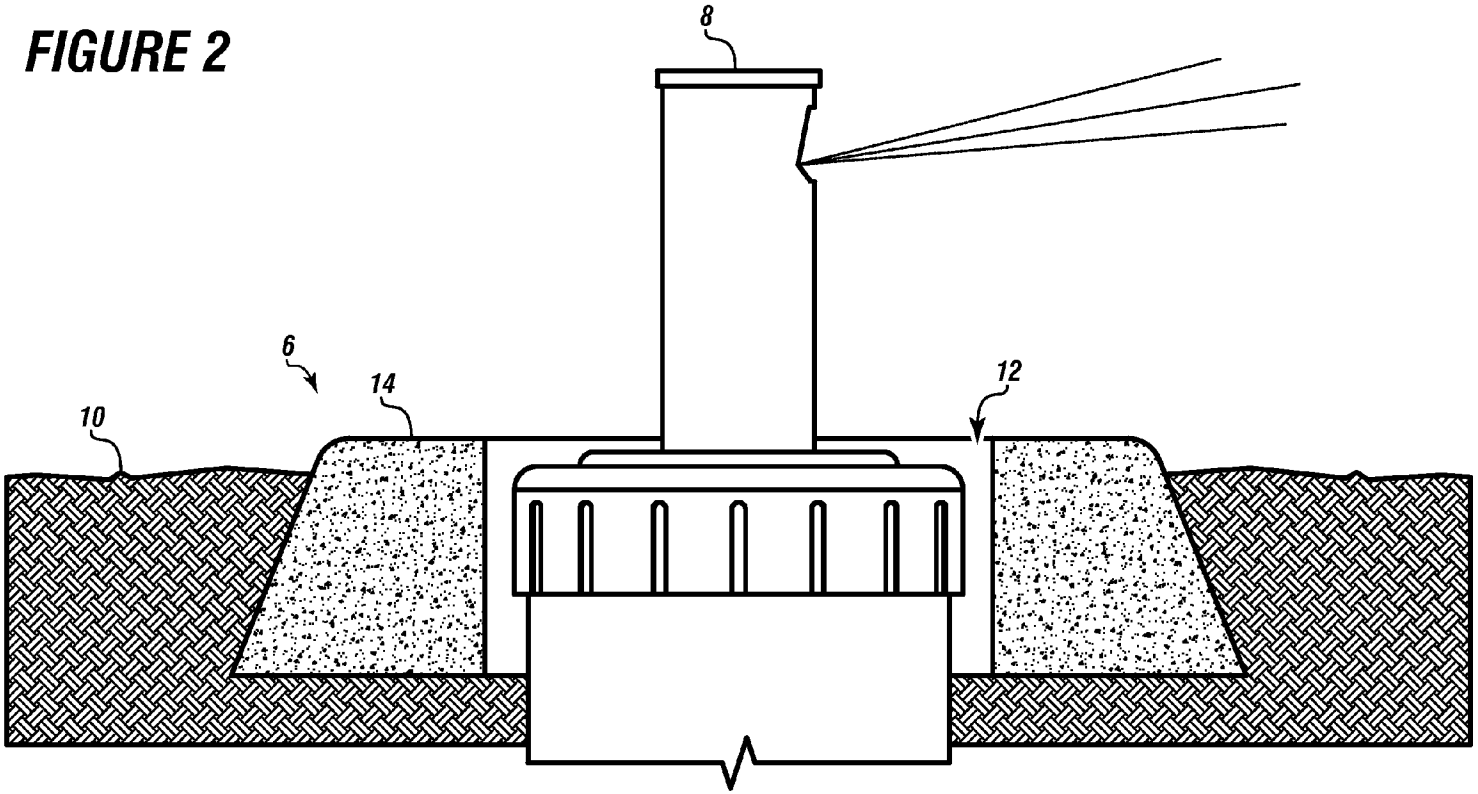
FIG. 2 is a cut view of the sprinkler donut as installed according to one or more embodiments.

Turning now to the Figures, FIG. 1 depicts a sprinkler donut made by the method and FIG. 2 is a cut view of the sprinkler donut installed in the sprinkler system according to one or more embodiments.

The sprinkler donut is used for protecting lawn sprinkler heads by forming a shield in places around the sprinkler heads after the system has been installed.

The sprinkler donut 6 is shown resting on the ground 10 around the sprinkler head 8.

The sprinkler donut 6 can have a central opening 12 for allowing the sprinkler head 8 to be surrounded or protected by a connected wall 14 of the sprinkler donut.

EXAMPLES OF THE METHOD

Example 1

20.48 ounces of sand can be mixed with 1.14 pounds of Portland cement and 24 grams of green pigment with 0.42 grams of homopolymer polypropylene fibers, such as Fibermesh™ 150 available from Propex Concrete systems cut in 0.5 inch segments for 4 minutes forming a first blend.

While mixing the dry blend, 11 milliliters of Eucon AC™ which contains calcium chloride and water is added to the dry blend and mixed in a high shear mixer for 3 minutes. Eucon AC also includes poly alphamethylstyrene.

12 donut shaped molds 6 inches wide are sprayed with a urethane release agent and placed in a room of 100 percent humidity and a temperature of 97 degrees Fahrenheit.

The liquid uncured donut mixture is deposited in each sprayed mold and then sprayed with Eucobar™ available from Euclid Chemical which is an evaporation retardant to keep the water in the composition as it cures.

The donut material is allowed to cure in the controlled environment for 8 hours and then removed forming a hard, lightweight donut that will ship in layers of 10 without filler and without breaking.

Microhardness testing of polyolefin fiber-reinforced Type III cement paste was performed.

Type III cement with two water-cement ratios (w/c) (0.38 and 0.46) was tested. For 0.38 w/c cement aged for 7 days, the mean Vickers microhardness found with a 0.981 N load was 620 MPa. For 0.46 w/c cement, the mean HV100 (Vickers hardness with 100 g f load) value was determined to be 435 MPa. It was shown that the Vickers microhardness data obtained at both w/c were not normally distributed, but were instead distributed according to a log-normal distribution.

The data displayed the same mean and variance at 95 percent confidence, as determined by the Kruskal-Wallis test. The indentation size effect (ISE) was quantified and the exponent n was found to be 2.24, while the load necessary to give a 2 mm indentation diagonal KL was 0.062 N. The minimum edge-to-edge distance between indentations at which the indentations did not affect each other was measured and found to be less than 12.5 mm, which was the smallest distance that could be measured with the microhardness tester utilized. Also, the Young's modulus was estimated from Knoop microhardness tests, and was found to be approximately 11 GPa for w/c=0.38, and 18 GPa for w/c=0.46, although there was no statistical difference between the two values at 95 percent confidence.

The second part of the experimental work consisted of microhardness testing in the interfacial transition zone (ITZ) of polyolefin fiber-reinforced Type III cement paste. The Knoop microhardness of the ITZ was measured using 0.245 N load. The mean Knoop microhardness HK25 of the bulk paste was found to be 542 MPa. Within the ITZ, a statistically less hard region was found to exist approximately 40 to 65 mm from the polyolefin fiber surface. The mean HK25 of this region was 393 MPa. The region less than 40 mm from the surface could not be investigated due to the indenter head impinging on the fiber.

The polymer reinforced donut was much harder than the cement donuts due to the polyolefin fiber surface of the cement paste.

As another example, the donut can be formed by mixing for 8 minutes 6 weight percent water with 93 weight percent of a dry mixture forming a first blend.

In this example, the dry mixture consists of 38 weight percent sand; 23 weight percent Portland cement; 1.2 weight percent pigment; and 1 weight percent polypropylene homopolymer fibers cut into strands less than 0.5 of an inch in length.

The dry mixture and water are blended for 3 minutes forming a first blend.

An accelerating admixture of 0.75 weight percent is then added to the first blend, which includes poly alphamethylstyrene forming a pliable donut material. The accelerating admixture consists of: 30 weight percent calcium chloride; and 70 weight percent water as well.

Onto a donut shaped mold is sprayed with a urethane release agent in a thickness of 0.5 ml.

Next the sprayed mold is filled with the pliable donut material and placed in a controlled environment.

The controlled environment is at a temperature between 98 degrees Fahrenheit and at a humidity of 100 percent.

Within 3 minutes of placing the mold containing pliable donut material into the controlled environment; an evaporation retardant is sprayed on the donut material prior to cure. The evaporation retardant prevents evaporation of water from the donut material.

Next, the sprayed donut material in the mold is allowed to remain in the mold 8 hours in the controlled environment. After 8 hours, the donut is removed from the mold for use around sprinkler heads of irrigation systems.

As another example, 5 weight percent water is mixed with 95 weight percent of a dry mixture for 5 minutes forming a first blend.

In this example, the dry mixture consists of 44 weight percent sand; 29 weight percent Portland cement; 0.0015 weight percent pigment; and 0.00120 weight percent polypropylene homopolymer fibers cut into strands less than 0.5 of an inch in length.

The first blend is then blended for 3 minutes with 0.5 weight percent of an accelerating admixture that includes poly alphamethylstyrene, forming a donut material.

Besides the poly alphamethylstyrene the accelerating admixture has in it 60 weight percent calcium chloride; and 40 weight percent water, wherein the weight percent of the water is based on the total weight percent of the first blend with the accelerating admixture.

In this example, a donut shaped mold is sprayed with a urethane release agent in a thickness of 1 ml.

The sprayed donut shaped molds are placed in a controlled environment, at a temperature of 101 degrees Fahrenheit and at a humidity of 98 percent.

The donut material is deposited into the sprayed donut shaped mold in the controlled environment.

Within 8 minutes of placing the donut material into the sprayed donut shaped molds, an evaporation retardant is sprayed on the donut material prior to cure.

The evaporation retardant prevents evaporation of water from the donut material.

The donut material remains in the donut shaped mold for 8 hours in the controlled environment after which the donut can be removed from the mold for use around sprinkler heads of irrigation systems.

While these embodiments have been described with emphasis on the embodiments, it should be understood that within the scope of the appended claims, the embodiments might be practiced other than as specifically described herein.

What is claimed is:

1. An accelerated cure method for making a strong, high durometer, reduced brittleness hydrated sprinkler donut, wherein the accelerated cure method comprises:

a. mixing for 2 to 5 minutes 5 weight percent to 8 weight percent water with 92 weight percent to 95 weight percent of a dry mixture forming a first blend, wherein the dry mixture consists of:
   (i) 30 weight percent to 53 weight percent sand;
   (ii) 20 weight percent to 40 weight percent Portland cement;
   (iii) 1 weight percent to 2 weight percent pigment; and
   (iv) 1 weight percent to 2 weight percent polypropylene homopolymer fibers cut into strands less than 0.5 of an inch in length;

b. blending for 3 to 4 minutes the first blend with 0.5 weight percent to 1 weight percent of an accelerating admixture, forming a donut material, wherein the accelerating admixture consists of:
   (i) 30 weight percent to 60 weight percent calcium chloride; and
   (ii) 40 weight percent to 60 weight percent water, wherein the weight percent of the water is based on the total weight percent of the first blend with the accelerating admixture;

c. spraying at least one donut shaped mold with a urethane release agent in a thickness of at least 1 ml;

d. placing the donut shaped molds in a controlled environment, wherein the controlled environment is at a temperature from 96 degrees Fahrenheit to 101 degrees Fahrenheit and at a humidity of at least 85 percent;

e. depositing the donut material into the sprayed donut shaped mold in the controlled environment;

f. spraying an evaporation retardant on the donut material prior to cure, within 8 minutes of placing the donut material in the sprayed donut shaped mold in the controlled environment, wherein the evaporation retardant prevents evaporation of water from the donut material;

g. allowing the donut to remain in the mold 8 to 12 hours in the controlled environment; and h. removing the donut from the mold for use around sprinkler heads of irrigation systems.

2. The method of claim 1, further comprising spraying a urethane onto the mold.

3. The method of claim 1, wherein the pigment is green, red, yellow, purple or blue.

4. The method of claim 1, wherein the formed donut is a 6 inch diameter donut that weighs 64 ounces.

5. A sprinkler donut comprising, a. 30 weight percent to 53 weight percent sand;

b. 20 weight percent to 40 weight percent Portland cement;

c. 1 weight percent to 2 weight percent pigment;

d. 1 weight percent to 2 weight percent polypropylene homopolymer fibers cut into strands less than 0.5 of an inch in length; and e. 0.5 weight percent to 1 weight percent of an accelerating admixture, wherein the accelerating admixture consists of:
   (i) 30 weight percent to 60 weight percent calcium chloride; and
   (ii) 40 weight percent to 60 weight percent water, wherein the weight percent of the water is based on the total weight percent of the first blend with the accelerating admixture.

* * * * *